US005698478A

United States Patent [19]

Yamamoto et al.

[11] Patent Number: 5,698,478

[45] Date of Patent: Dec. 16, 1997

[54] INK JET PRINTING CLOTH, TEXTILE PRINTING PROCESS, AND PRINT

[75] Inventors: Tomoya Yamamoto, Kawasaki; Masahiro Haruta, Tokyo; Shoji Koike, Yokohama; Koromo Shirota, Kawasaki; Aya Yoshihira, Yokohama; Mariko Suzuki, Kawasaki, all of Japan

[73] Assignee: Canon Kabushiki Kaisha, Tokyo, Japan

[21] Appl. No.: 547,207

[22] Filed: Oct. 24, 1995

[30] Foreign Application Priority Data

Oct. 25, 1994 [JP] Japan ..... 6-260058
Oct. 19, 1995 [JP] Japan ..... 7-271235

[51] Int. Cl.[6] ..... B41M 5/00; B41J 2/01

[52] U.S. Cl. ..... 442/153; 347/105; 428/195; 428/375; 428/393; 428/396

[58] Field of Search ..... 347/105; 428/195, 428/375, 393, 396; 442/153

[56] References Cited

U.S. PATENT DOCUMENTS

| | | | |
|---|---|---|---|
| 4,655,834 | 4/1987 | Haruta et al. | 106/20 |
| 4,689,078 | 8/1987 | Koike et al. | 106/22 |
| 4,702,742 | 10/1987 | Iwata et al. | 8/495 |
| 4,725,849 | 2/1988 | Koike et al. | 346/1.1 |
| 4,838,938 | 6/1989 | Tomida et al. | 106/22 |
| 4,849,770 | 7/1989 | Koike et al. | 346/1.1 |
| 4,853,036 | 8/1989 | Koike et al. | 106/20 |
| 4,957,553 | 9/1990 | Koike et al. | 106/20 |
| 4,969,951 | 11/1990 | Koike et al. | 106/22 |
| 5,075,699 | 12/1991 | Koike et al. | 346/1.1 |
| 5,082,496 | 1/1992 | Yamamoto et al. | 106/22 |
| 5,124,718 | 6/1992 | Koike et al. | 346/1.1 |
| 5,250,121 | 10/1993 | Yamamoto et al. | 106/22 R |
| 5,348,557 | 9/1994 | von der Eltz et al. | 8/188 |
| 5,358,558 | 10/1994 | Yamamoto et al. | 106/22 |
| 5,396,275 | 3/1995 | Koike et al. | 347/101 |
| 5,403,358 | 4/1995 | Aston et al. | 8/445 |
| 5,468,553 | 11/1995 | Koike et al. | 428/224 |
| 5,494,733 | 2/1996 | Koike et al. | 428/224 |

FOREIGN PATENT DOCUMENTS

| | | | |
|---|---|---|---|
| 177111 | 4/1986 | European Pat. Off. | 428/195 |
| 534660 | 3/1993 | European Pat. Off. | 428/195 |
| 558914 | 9/1993 | European Pat. Off. | 428/195 |
| 590397 | 4/1994 | European Pat. Off. | 428/195 |
| 624682 | 11/1994 | European Pat. Off. | 428/195 |
| 3543495 | 6/1986 | Germany | 428/195 |
| 54-59936 | 5/1979 | Japan | 347/1 |
| 6331594 | 3/1986 | Japan | 428/195 |
| 63-6183 | 1/1988 | Japan | 428/195 |
| 435351 | 7/1988 | Japan | 428/195 |
| 5148775 | 6/1993 | Japan | 428/195 |
| 5222684 | 8/1993 | Japan | 428/195 |

OTHER PUBLICATIONS

Chemica Abstracts, vol. 108, No. 6, Abstract No. 39573n, "Ink-jet printing of fabrics", (Feb., 1988).

Derwent (Database WPI) Section Ch, Week 8939, AN 89-281391 with respect to JP 1-204,783 of Aug. 17, 1989.

*Primary Examiner*—Bruce H. Hess

*Attorney, Agent, or Firm*—Fitzpatrick, Cella, Harper & Scinto

[57] ABSTRACT

Disclosed herein is an ink-jet printing cloth which can be dyed with inks containing a reactive dye and is composed mainly of cellulose fiber, wherein the cloth contains 0.1 to 50% by weight of a cationic substance, 0.01 to 5% by weight of an alkaline substance and 0.01 to 20% by weight of the ammonium salt of a polyvalent acid, the proportions of said cationic and alkaline substances and said ammonium salt being based on the dry weight of the cloth.

22 Claims, 2 Drawing Sheets

INK JET PRINTING CLOTH, TEXTILE PRINTING PROCESS, AND PRINT

BACKGROUND OF THE INVENTION

1. Field of the Invention

The present invention relates to an ink-jet printing cloth and a textile printing process, by which the problem of staining on white portions can be solved, and a print produced by such a process.

2. Related Background Art

Heretofore, the processes for ink-jet printing on cloth, have been a process in which cloth is temporarily adhered to a nonstretchable, flat support, on which an adhesive has been coated, to print the cloth by a printer (Japanese Patent Application Laid-Open No. 63-6183); a process in which cloth treated with an aqueous solution containing a water-soluble polymeric substance, a water-soluble salt and water-insoluble inorganic fine particles, which are all non-dyeable with any dye, is dyed by ink-jet (Japanese Patent Publication No. 63-31594); a process in which cellulose fiber is pretreated with a solution containing an alkaline substance, urea or thiourea, and a water-soluble polymeric substance, dyed by ink-jet with inks containing a reactive dye and subjected to a fixing treatment under dry heat (Japanese Patent Publication No. 4-35351), etc.

Objects of these prior art processes are to prevent bleeding of images and provide a sharp pattern and a bright print high in color depth. However, these processes do not yet achieve the same color depth and brightness as those of prints obtained by the conventional printing process (screen printing).

In order to provide a print high in color depth, it has thus been proposed to obtain a cationized cotton cloth by pretreating a cotton cloth with a cationic substance and printing on this cationized cloth (Japanese Patent Application Laid-Open Nos. 5-148775 and 5-222684). However, this process causes staining on the white portions to a significant extent, and hence requires masking of the white portions.

SUMMARY OF THE INVENTION

It is therefore an object of the present invention to provide an ink-jet printing cloth and a textile printing process which can solve, at the same time, the above-described problems, i.e., a problem of insufficient color density in the resulting image, a problem of a shortage of color depth and a problem of staining on white portions, and to provide a print produced by such a process.

The above object can be achieved by the present invention described below.

The present inventors have carried out an extensive investigation with a view toward solving the above-described problems, thus leading to completion of the present invention.

According to the present invention, there is thus provided an ink-jet printing cloth which can be dyed with inks containing a reactive dye. This cloth is composed mainly of cellulose fiber and contains, based on the dry weight of the cloth, 0.1 to 50% by weight of a cationic substance, 0.01 to 5% by weight of an alkaline substance and 0.01 to 20% by weight of the ammonium salt of a polyvalent acid.

According to the present invention, there is also provided a textile printing process comprising applying textile printing inks to a cloth by an ink-jet system, wherein said cloth is the ink-jet printing cloth described above, and a dyeing treatment is carried out after the application of the inks to the cloth, followed by a washing treatment.

According to the present invention, there is further provided a print produced in accordance with the textile printing process described above.

DESCRIPTION OF THE PREFERRED EMBODIMENTS

Figure 1:
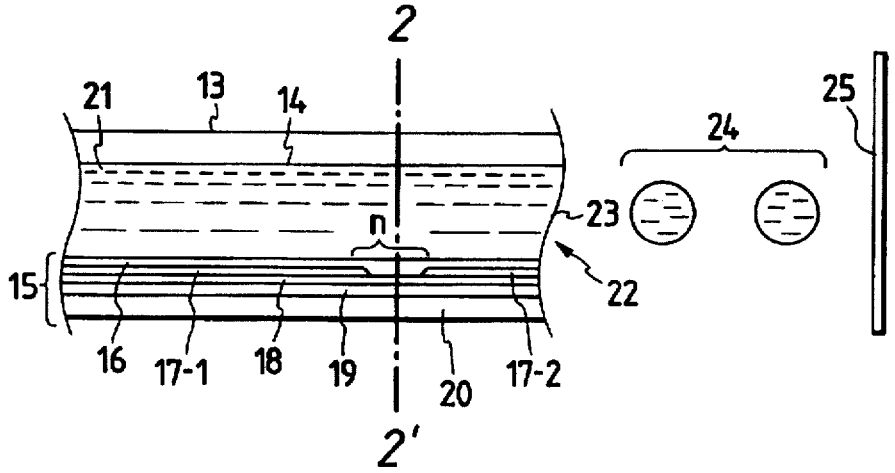
FIG. 1 is a longitudinal cross-sectional view of a head of an ink-jet printing apparatus.

It has been found that when a cationic substance, an alkalizing agent and the ammonium salt of a polyvalent inorganic acid or polyvalent organic acid are contained in a cloth, ink-jet printing on this cloth with inks containing a reactive dye results in a sharp image free of bleeding and high in color depth. At the same time, the problem of staining on white portions can be solved.

This is considered to be attributable to the fact that the ammonium salt of the polyvalent acid is first decomposed in a heating step of a dyeing and fixing treatment to generate and release ammonia, and a polyvalent acid formed as an anion at this time preferentially and firmly combines with the cationic substance, whereby the coupling of the reactive dye generated as an anion upon washing with the cationic substance is inhibited so as to prevent redyeing of the dye.

In the ink-jet printing process, the amount of an ink (dye) to be applied upon printing is very little compared with the conventional screen printing process, and so staining on white portions occurs to a lesser extent. On the other hand, this process has difficulty enhancing color depth. Therefore, the color depth has been enhanced by pretreating the cloth with a specific cationic substance. However, such a process has caused the problem of staining on white portions to some extent. However, the pretreatment by the combination according to the present invention permits the compatibility of the prevention of staining on white portions with the enhancement of color depth. More specifically, the anion generated in the heating step is used as a masking agent for the cationic substance in the washing step.

The present invention will hereinafter be described in more detail by the following preferred embodiments.

The cloth in the present invention is a cloth composed mainly of cellulose fiber or regenerated cellulose fiber. Of these fibers, the cellulose fiber means fiber comprising cellulose as a principal component. Examples thereof include natural cellulose fibers such as cotton and hemp. The regenerated cellulose fiber means fiber obtained by chemically dissolving natural cellulose contained in wood pulp and cotton linters once to regenerate cellulose and redo spinning. Examples thereof include rayon, cupra and polynosic fiber. Of these fibers, cotton which is cellulose fiber derived from seeds of a plant, and viscose rayon which is regenerated cellulose closest to cotton are particularly preferred for use in the present invention.

The term "printing cloth" as used herein means a woven fabric, nonwoven fabric, knitted fabric, felted fabric or the like. The cloth is preferably formed of the cellulose fiber alone. However, blended woven fabrics or nonwoven fabrics of the cellulose fiber and one or more other materials may also be used as ink-jet printing cloths in the present invention so far as they contain the cellulose fiber at a blending ratio of at least 70% preferably at least 80%

A moisture regain in the cloth, which primarily characterizes the ink-jet printing cloth according to the present invention, is adjusted within a range of from 13.5 to 108.5%, preferably from 14.5 to 88.5%, more preferably from 15.5 to 68.5%. Any moisture regain lower than 13.5% results in a printing cloth insufficient in coloring ability and color yield. If the moisture regain exceeds 108.5% on the other hand, disadvantages tend to occur in conveyability and particularly, bleeding.

The measurement of the moisture regain in the cloth was conducted by reference to JIS L 1019.

More specifically, 100 g of a sample was precisely weighed and placed in an oven at 105°±2° C., thereby drying the sample to a constant weight. Thereafter, the cloth was washed with water and then dried again to a constant weight to measure the weight of fiber alone after the drying. The moisture regain was then determined in accordance with the following equation:

$$\text{Moisture regain } (\%)=\{(W-W')/W''\}\times 100$$

wherein W is a weight of the cloth before the drying, and W' is a weight of the cloth after the drying, and W" is a weight of the fiber after the water washing and drying.

When the ink-jet printing cloth according to the present invention is composed mainly of the cellulose fiber, it is preferable that the cloth should have the above-described moisture regain and besides, the cellulose fiber should have an average length ranging from 25 to 60 mm, preferably from 30 to 55 mm, more preferably from 35 to 50 mm. Any average fiber length shorter than 25 mm results in a printing cloth which tends to have disadvantages in the occurrence of bleeding and definition. On the other hand, any average fiber length longer than 60 mm results in a printing cloth which tends to undergo deterioration in conveyability and color yield.

The average fiber length was determined in accordance with the staple diagram method by reference to JIS L 1019.

When the ink-jet printing cloth according to the present invention is composed mainly of the cellulose fiber, it is also preferable that the cloth should have the above-described moisture regain. In addition, the cellulose fiber should have an average thickness ranging from 0.6 to 2.2 deniers and an average number of natural twist ranging from 70/cm to 150/cm.

More specifically, although it is only necessary for the average thickness of the fiber to fall within the range of from 0.6 to 2.2 deniers, it is preferably within a range of from 0.7 to 2.0 deniers, more preferably from 0.8 to 1.8 deniers. Any average thickness of the fiber less than 0.6 denier results in a printing cloth which tends to undergo deterioration in color yield and conveyability. On the other hand, any average thickness of the fiber exceeding 2.2 deniers results in a printing cloth which tends to cause bleeding and undergo deterioration in definition.

Although it is also only necessary for the average number of natural twist of the fiber to fall within the range of from 70/cm to 150/cm, it is preferably within a range of from 80 to 150/cm, more preferably from 90 to 150/cm.

Any average number of natural twist of the fiber less than 70/cm results in a printing cloth which is deteriorated in color yield, and tends to cause bleeding and undergo deterioration in definition. On the other hand, any average number of natural twist of the fiber exceeding 150/cm results in a printing cloth which tends to undergo deterioration in conveyability.

With respect to the measurement of the average thickness of the fiber, its Micronaire fineness was determined by the Micronaire method, and the value was converted into the weight per 9000 m to express it in terms of a denier unit.

With respect to the average number of natural twist of the fiber, 50 cellulose fibers were optionally taken out of the cloth to separately measure their number of twist through a microscope, thereby finding their number of twist per cm and determining an average value thereof.

As the cationic substance useful in the practice of the present invention, all cationic polymers, reactive quaternary ammonium compounds, cationic inorganic fine particles may be used. However, preferable examples thereof include cationized polyvinyl pyrrolidone (PVP), cationized polyacrylamide (PAAm), and cationized polyallylamine (PAA), which will be described subsequently.

The cationized PVP is a copolymer of vinylpyrrolidone and a monomer containing a quaternary ammonium salt compound and has m units of the structural unit represented by the following formula (1) and n units of the structural unit represented by the following formula (2):

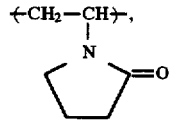

(1)

and

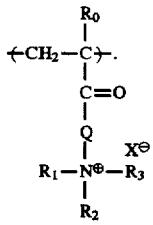

(2)

In the formulae, X is Cl or F, $R_0$ is H or $CH_3$, $R_1$, $R_2$ and $R_3$ are, independently of one another, $CH_3$ or $C_2H_5$, and Q is $C_2H_4$ or O—$C_2H_4$.

Here, a ratio of m to n is within a range of from 8:2 to 2:8, preferably from 6:4 to 2:8. Any ratio of the vinylpyrrolidone group to the quaternary ammonium group exceeding 8:2 results in a printing cloth which fails to achieve sufficient color depth. On the other hand, any ratio lower than 2:8 results in a printing cloth which tends to undergo staining on white portions.

The cationized PVP preferably has a weight average molecular weight ranging from 3,000 to 100,000.

The cationized PAAm is a copolymer of acrylamide and a quaternary ammonium salt compound and has p units of the structural unit represented by the following formula (3) and q units of the structural unit represented by the following formula (4):

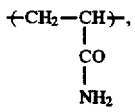

(3)

and

-continued

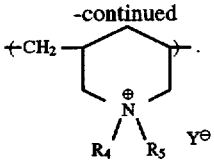

(4)

In the formulae, Y is Cl or F, and $R_4$ and $R_5$ are, independently of each other, $CH_3$ or $C_2H_5$.

Here, a ratio of p to q is preferably within a range of from 8:2 to 2:8, more preferably from 6:4 to 2:8. Any ratio of the amide group to the quaternary ammonium group exceeding 8:2 results in a printing cloth which fails to achieve sufficient color depth. On the other hand, any ratio lower than 2:8 results in a printing cloth which tends to undergo staining on white portions.

The cationized PAAm preferably has a weight average molecular weight ranging from 3,000 to 1,000,000.

The cationized PAA has structural units represented by the formula

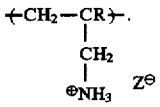

(5)

In the formula, Z is Cl or F, and R is H or $CH_3$.

The cationized PAA preferably has a weight average molecular weight ranging from 3,000 to 100,000.

The amount of these cationic substances to be used is preferably 0.1 to 50% by weight, more preferably 0.5 to 40% by weight based on the dry weight of the cloth. Any amount of the cationic substances less than 0.1% by weight results in a printing cloth which tends to cause bleeding and undergo deterioration in color depth. On the other hand, any amount exceeding 50% by weight results in a printing cloth which tends to undergo staining on white portions.

Examples of the alkaline substance useful in the present invention include alkali metal hydroxides such as sodium hydroxide and potassium hydroxide; amines such as mono-, di- and triethanolamines; and alkali metal carbonates and bicarbonates such as sodium carbonate, potassium carbonate and sodium bicarbonate. Further, sodium trichloroacetate and the like, which form an alkaline substance by steaming or under dry heat, may also be used. Sodium carbonate and sodium bicarbonate used in dyeing of reactive dyes are particularly preferred alkaline substances. The amount of the alkaline substance to be used is preferably 0.01 to 5% by weight based on the dry weight of the cloth. If the amount of the alkaline substance to be used is less than 0.01% by weight, the reaction of dyes contained in inks used with the fiber becomes insufficient. On the other hand, any amount exceeding 5% by weight results in a printing cloth which tends to lower the strength of the fiber and undergo deterioration in coloring stability due to hydrolysis of dyes contained in inks used.

Further, examples of the ammonium salt of the polyvalent acid useful in the practice of the present invention include the ammonium salts of polyvalent inorganic acids such as sulfuric acid, phosphoric acid and boric acid; the ammonium salts of polyvalent organic carboxylic acids such as succinic acid and citric acid; the ammonium salts of polyvalent alkylbenzenesulfonic acids such as toluenedisulfonic acid and methylnaphthalenedisulfonic acid; and the ammonium salts of polyvalent polymer acids composed of maleic acid, acrylic acid, styrenesulfonic acid and/or the like. Ammonium sulfate and ammonium citrate are particularly preferred ammonium salts. The amount of the ammonium salt to be used is preferably 0.01 to 20% by weight, more preferably 0.03 to 15% by weight based on the dry weight of the cloth. Any amount of the ammonium salt less than 0.01% by weight results in a printing cloth which undergoes marked staining on white portions. On the other hand, any amount exceeding 20% by weight results in a printing cloth which tends to lower color yield.

The combined proportion of the alkaline substance to the ammonium salt of the polyvalent acid is preferably within a range of from 1:1 to 1:10, more preferably from 1:2 to 1:5 in terms of weight ratio.

If the proportion of the alkaline substance is higher than the upper limit of the above range, the problem of staining on white portions is not satisfactorily solved. On the other hand, if the proportion of the ammonium salt is higher than the upper limit of the above range, the resulting print tends to exhibit lowered color brightness.

A substance selected from the group consisting of polymers, water-soluble metal salts, urea and thiourea may also be used in combination as a pretreatment agent.

Examples of water-soluble polymers include natural water-soluble polymers such as starch from corn, wheat and the like; cellulosic substances such as carboxymethylcellulose, methylcellulose and hydroxyethylcellulose; polysaccharides such as sodium alginate, gum arabic, locust bean gum, tragacanth gum, guar gum and tamarind seed; proteins such as gelatin and casein; tannin and derivatives thereof; and lignin and derivatives thereof.

Examples of synthetic polymers include polyvinyl alcohol type compounds, polyethylene oxide type compounds, water-soluble acrylic polymers, water-soluble maleic anhydride polymers and the like. Of these, the polysaccharide polymers and cellulosic polymers are preferred.

Examples of the water-soluble metal salts include compounds such as halides of alkali metals and alkaline earth metals, which form typical ionic crystals and have a pH of 4 to 10 in the form of an aqueous solution. Representative examples of such compounds are NaCl, $Na_2SO_4$, KCl and $CH_3COONa$ for alkali metal salts, and $CaCl_2$ and $MgCl_2$ for alkaline earth metal salts. Of these, salts of Na, K and Ca are preferred.

As textile printing inks used for the ink-jet printing cloths according to the present invention, ink-jet printing inks composed of a reactive dye and an aqueous liquid medium may preferably be used.

Among others, reactive dyes having a vinylsulfone group and/or a monochlorotriazine group may preferably be used in the process of the present invention. Specific examples of these dyes include those typified by C.I. Reactive Yellow 2, 15, 37, 42, 76 and 95; C.I. Reactive Red 21, 22, 24, 33, 45, 111, 112, 114, 180, 218 and 226; C.I. Reactive Blue 15, 19, 21, 38, 49, 72, 77, 176, 203 and 220; C.I. Reactive Orange 5, 12, 13 and 35; C.I. Reactive Brown 7, 11, 33 and 46; C.I. Reactive Green 8 and 19; C.I. Reactive Violet 2, 6 and 22; and C.I. Reactive Black 5, 8, 31 and 39.

Other preferable dyes include reactive dyes having at least two reactive groups in their molecules. Specific examples of these dyes include those typified by C.I. Reactive Yellow 168 and 175; C.I. Reactive Red 228 and 235; C.I. Reactive Blue 230 and 235; C.I. Reactive Orange 95; and C.I. Reactive Brown 37. However, dyes used in the present invention are not limited to the above-mentioned dyes.

These dyes may be contained in an ink either singly or in any combination thereof. It is also possible to use the dyes different in hue in combination. The total amount of the dyes to be used is generally within a range of from 5 to 30% by weight, preferably from 5 to 25% by weight, more preferably from 5 to 20% by weight based on the total weight of the ink. Any amount less than 5% by weight results in an ink insufficient in color depth. On the other hand, any amount exceeding 30% by weight results in an ink insufficient in ejection properties.

Water, an essential component of the liquid medium making up the ink used in the printing process of the present invention, is used within a range of from 30 to 90% by weight, preferably from 40 to 90% by weight, more preferably from 50 to 85% by weight based on the total weight of the ink.

The above components are essential components of the ink-jet printing inks used in the process of the present invention. However, general organic solvents may also be used in combination with water as other components of the liquid medium for the inks.

Examples thereof include ketones and keto-alcohols, such as acetone and diacetone alcohol; ethers, such as tetrahydrofuran and dioxane; addition polymers of oxyethylene or oxypropylene with diethylene glycol, triethylene glycol, tetraethylene glycol, dipropylene glycol, tripropylene glycol, polyethylene glycol, polypropylene glycol and the like; alkylene glycols, the alkylene moiety of which has 2 to 6 carbon atoms, such as ethylene glycol, propylene glycol, trimethylene glycol, butylene glycol and hexylene glycol; triols, such as 1,2,6-hexanetriol and glycerol; thiodiglycol; lower alkyl ethers of polyhydric alcohols, such as ethylene glycol monomethyl (or monoethyl) ether, diethylene glycol monomethyl (or monoethyl) ether and triethylene glycol monomethyl (or monoethyl) ether; lower dialkyl ethers of polyhydric alcohols, such as triethylene glycol dimethyl (or diethyl) ether and tetraethylene glycol dimethyl (or diethyl) ether; sulfolane; N-methyl-2-pyrrolidone; and 1,3-dimethyl-2-imidazolidinone.

The content of the water-soluble organic solvent as described above is generally within a range of from 3 to 60% by weight, preferably from 5 to 50% by weight based on the total weight of the ink.

The liquid medium components as described above may be used either singly or in any combination thereof if used in combination with water. However, the most preferred composition of the liquid medium is that comprising at least one polyhydric alcohol as such a solvent. Among others, a single solvent of thiodiglycol or a mixed solvent system of diethylene glycol and thiodiglycol is particularly preferred.

Although the principal components of the inks used in the process of the present invention are as described above, a Variety of other additives such as a dispersant, a surfactant, a viscosity modifier, a surface tension modifier and an optical whitening agent may be added to the inks as needed.

Examples of such additives may include viscosity modifiers such as polyvinyl alcohol, cellulose and derivatives thereof, and water-soluble resins; various cationic or nonionic surfactants; surface tension modifiers such as diethanolamine and triethanolamine; pH adjustors comprising a buffer solution; mildew-proofing agents; and the like.

The ink-jet printing process of the present invention is a process in which the printing inks as described above are printed on the ink-jet printing cloth according to the present invention. An ink-jet printing system used may be any conventionally-known ink-jet recording system. However, the method described in Japanese Patent Application Laid-Open No. 54-59936, i.e., a system in which thermal energy is applied to an ink so as to undergo rapid volume change, thus ejecting the ink from a nozzle, is the most effective method. When printing is conducted on the ink-jet printing cloth according to the present invention by such a system, stable printing is feasible.

In order to obtain a print particularly high in quality, it is preferred that an ejected ink droplet be within a range of from 20 to 200 pl, and the shot-in ink quantity be within a range of from 4 to 40 nl/mm$^2$.

An illustrative example of an apparatus which is suitable for use in textile printing using the ink-jet printing cloth according to the present invention is an apparatus in which thermal energy corresponding to recording signals is applied to ink within a printing head, and ink droplets are generated by the thermal energy.

Figure 2:
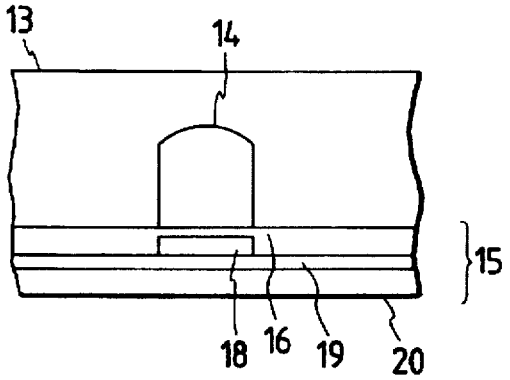
FIG. 2 is a transverse cross-sectional view of the head of the ink-jet printing apparatus.
Figure 3:
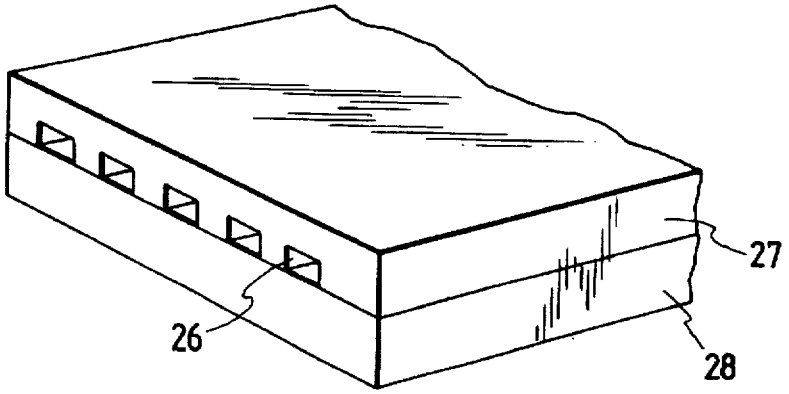
FIG. 3 is a perspective view of the appearance of a multi-head which is an array of such heads as shown in FIG. 1.

Examples of the construction of a head, which is a main component of such an apparatus, are illustrated in FIGS. 1, 2 and 3.

FIG. 1 is a cross-sectional view of a head 13 taken along the flow path of the ink. FIG. 2 is a cross-sectional view taken along line 2—2' in FIG. 1. FIG. 3 illustrates a multi-head composed of an array of a number of heads as shown in FIG. 1.

In FIG. 1, the head 13 is formed by bonding a glass, ceramic or plastic plate or the like, having a groove 14 through which ink is passed, to a heating head 15, which is used for thermal recording (in FIG. 1 and 2, an illustrative example is shown, however, the invention is not limited). The heating head 15 is composed of a protective film 16 made of silicon oxide or the like, aluminum electrodes 17-1 and 17-2, a heating resistor layer 18 made of nichrome or the like, a heat accumulating layer 19, and a substrate 20 made of alumina or the like, having a good heat radiating property.

The ink 21 comes up to an ejection orifice (a minute opening) 22 and forms a meniscus 23 due to a pressure P.

Now, upon application of electric signals to the electrodes 17-1 and 17-2, the heating head 15 rapidly generates heat at the region shown by n to form bubbles in the ink 21 which is in contact with this region. The meniscus 23 of the ink is projected by the action of the pressure thus produced, and the ink 21 is ejected from the orifice 22 in the form of printing droplets 24 to a cloth 25 of the present invention composed mainly of cellulose fiber.

The multi-head illustrated in FIG. 3 is formed by closely bonding a glass plate 27 having a number of channels 26 to a heating head 28 similar to the head illustrated in FIG. 1.

Figure 4:
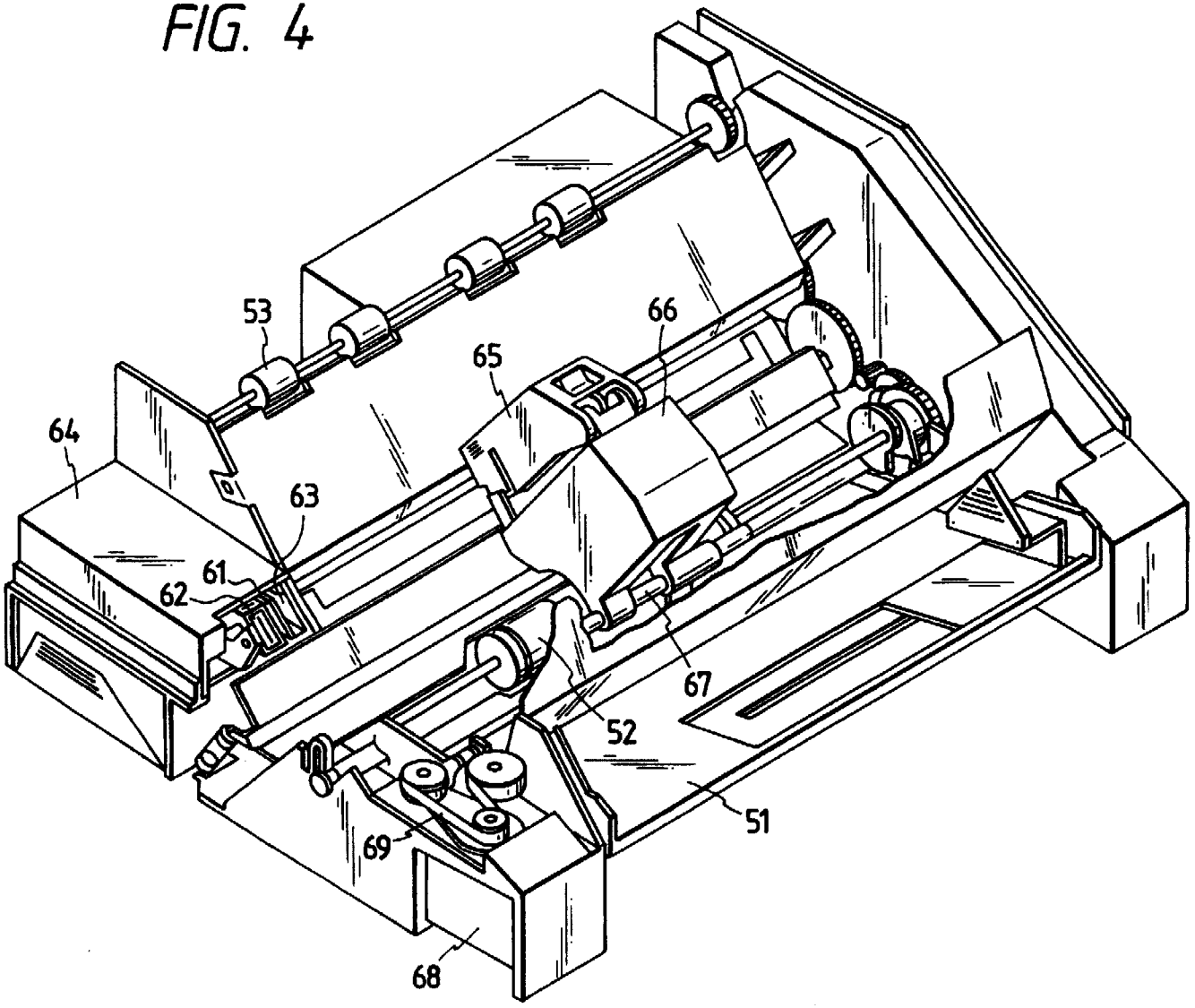
FIG. 4 is a perspective view of an illustrative ink-jet printing apparatus.

FIG. 4 illustrates an ink-jet printing apparatus in which such a head has been incorporated.

In FIG. 4, reference numeral 61 designates a blade serving as a wiping member, one end of which is held stationary by a blade-holding member to form a cantilever. The blade 61 is positioned adjacent to the region in which the printing head 65 operates, and, in this embodiment, it protrudes into the course through which the printing head 65 is moved. Reference numeral 62 indicates a cap, which is at a home position adjacent to the blade 61, and it moves in a direction perpendicular to the direction in which the printing head 65 is moved thus coming into contact with the face of ejection openings to cap them. Reference numeral 63 designates an absorbing member provided adjoiningly to the blade 61 and, similar to the blade 61, it protrudes into the course through which the printing head 65 is moved. The above-described blade 61, cap 62 and absorbing member 63 constitute an ejection-recovery portion 64, where the blade 61 and the absorbing member 63 remove water, dust and/or the like from the face of the ink-ejecting openings.

Reference numeral 65 designates the printing head having an ejection-energy-generating means and serving to eject the ink onto the cellulose fiber-containing cloth set opposite the ejection opening face provided with ejection openings to conduct printing. Reference numeral 66 indicates a carriage on which the printing head 65 is mounted so that the printing head 65 can be moved. The carriage 66 is slidably interlocked with a guide rod 67 and is connected (not illustrated) to a belt 69 driven by a motor 68. Thus, the carriage 66 can be moved along the guide rod 67 so that the printing head 65 can be moved from a printing region to a region adjacent thereto.

Reference numerals 51 and 52 denote a cloth feeding part from which the cloths of the present invention composed of mainly of cellulose fibers are separately inserted, and cloth feed rollers driven by a motor (not illustrated), respectively. By means of this construction, the cloth according the present invention is fed to the position opposite to the ejection opening face of the printing face of the printing head, and discharged from a cloth discharge section provided with cloth discharge rollers 53 as printing progresses.

In the above construction, the cap 62 in the head recovery portion 64 recedes from the path of motion of the printing head 65 when the printing head 65 is returned to its home position, for example, after completion of printing, and the blade 61 remains protruding into the path of motion. As a result, the ejection opening face of the printing head 65 is wiped. When the cap 62 comes into contact with the ejection opening face of the printing head 65 to cap it, the cap 65 is moved so as to protrude into the path of motion of the printing head 65.

When the printing head 65 is moved from its home position to the position at which printing is started, the cap 62 and the blade 61 are at the same positions as the positions for the wiping as described above. As a result, the ejection opening face of the printing head 65 is also wiped at the time of this movement. The above movement of the printing head 65 to its home position is made not only when the printing is completed or the printing head is recovered for ejection, but also when the printing head is moved between printing regions for the purpose of printing, during which it is moved to the home position adjacent to each printing region at given intervals, so that the ejection opening face is wiped in accordance with this movement.

The printing inks applied onto the ink-jet printing cloth of this invention in accordance with the process of the present invention in the above-described manner only adhere to the cloth in this state. Accordingly, it is preferable to subsequently subject the cloth to a process for reactively fixing the dyes in the inks to the fiber and a process for removing unfixed dyes. Such reactive fixing and removal of the unreacted dyes may be conducted in accordance with any conventionally-known method. Such a treatment may be conducted in accordance with the conventionally-known method in which the printed cloth is treated, for example, by a steaming process, an HT steaming process or a thermofix process, or in case the cloth used has not been pretreated with an alkali, by an alkaline pad-steam process, an alkaline blotch-steam process, an alkaline shock process or an alkaline cold fix process, and then washed.

The present invention will hereinafter be described more specifically by the following Examples and Comparative Examples. Incidentally, all designations of "part" or "parts" and "%" as will be used in the following examples mean part or parts by weight and % by weight unless expressly noted.

Preparation of Ink (A):

| | |
|---|---|
| Reactive dye (C.I. Reactive Yellow 95) | 10 parts |
| Thiodiethanol | 24 parts |
| Diethylene glycol | 11 parts |
| Water | 55 parts. |

All the above components were mixed, and the liquid mixture was adjusted to pH 8.4 with sodium hydroxide. After stirring the mixture for 2 hours, it was filtered through a "Fluoropore Filter FP-100" (trade name; product of Sumitomo Electric Industries, Ltd.), thereby obtaining Ink-Jet Printing Ink (A).

Preparation of Ink (B):

| | |
|---|---|
| Reactive dye (C.I. Reactive Red 24) | 10 parts |
| Thiodiethanol | 15 parts |
| Diethylene glycol | 10 parts |
| Tetraethylene glycol dimethyl ether | 5 parts |
| Water | 60 parts. |

All the above components were mixed, and the liquid mixture was adjusted to pH 7.9 with sodium hydroxide. After stirring the mixture for 2 hours, it was filtered through a "Fluoropore Filter FP-100" (trade name; product of Sumitomo Electric Industries, Ltd.), thereby obtaining Ink-Jet Printing Ink (B).

Preparation of Ink (C):

| | |
|---|---|
| Reactive dye (C.I. Reactive Blue 72) | 13 parts |
| Thiodiethanol | 23 parts |
| Triethylene glycol monomethyl ether | 6 parts |
| Water | 58 parts. |

All the above components were mixed, and the liquid mixture was adjusted to pH 8.3 with sodium hydroxide. After stirring the mixture for 2 hours, it was filtered through a "Fluoropore Filter FP-100" (trade name; product of Sumitomo Electric Industries, Ltd.), thereby obtaining Ink-Jet Printing Ink (C).

Preparation of Ink (D):

| | |
|---|---|
| Reactive dye (C.I. Reactive Brown 11) | 2 parts |
| Reactive dye (C.I. Reactive Orange 12) | 1.5 parts |
| Reactive dye (C.I. Reactive Black 39) | 6.5 parts |
| Thiodiethanol | 23 parts |
| Diethylene glycol | 5 parts |
| Isopropyl alcohol | 3 parts |
| Water | 59 parts. |

All the above components were mixed, and the liquid mixture was adjusted to pH 8.2 with sodium hydroxide. After stirring the mixture for 2 hours, it was filtered through a "Fluoropore Filter FP-100" (trade name; product of Sumitomo Electric Industries, Ltd.), thereby obtaining Ink-Jet Printing Ink (D).

EXAMPLE 1

A 100% cotton woven fabric formed of Egyptian cotton having an average fiber length of 40 mm, an average fiber thickness of 1.3 denier and an average number of natural twist of 90/cm was dipped into a tank containing an aqueous solution of 3% of a copolymer of vinylpyrrolidone and trimethylaminoethyl methacrylate chloride (ratio of the comonomers=1:1, weight average molecular weight: 10,000), 1% of sodium carbonate and 3% of ammonium sulfate, squeezed to a pickup of 100% and then dried to adjust the moisture regain of the fabric to 20%.

Ink-Jet Printing Inks (A through D) obtained in the above-described manner were charged in a "Color Bubble Jet Printer BJC-600" (trade name, manufactured by Canon Inc.) to print solid print samples (100% and 200% duties) of 2×10 cm on the thus-pretreated woven fabric. The solid print samples of each color were fixed by a steaming treatment at 102° C. for 8 minutes. Thereafter, these print samples were washed with water to evaluate the resulting prints as to coloring ability, resistance to bleeding and susceptibility to staining on white portions. The results are shown in Table 1.

As apparent from Table 1, even the solid print samples of 100% duty were able to achieve high color depth, and all the print samples were good from the viewpoint of resistance to bleeding and susceptibility to staining on white portions.

EXAMPLE 2

The same woven fabric as that used in Example 1 was dipped into a tank containing an aqueous solution of 0.5% of a copolymer of vinylpyrrolidone and trimethylaminoethyl methacrylate chloride (ratio of the comonomers=1:1, weight average molecular weight: 100,000), 1% of sodium carbonate and 3% of ammonium sulfate, squeezed to a pickup of 100% and then dried to adjust the moisture regain of the fabric to 20%.

Using this woven fabric, printing was conducted in the same manner as in Example 1. The solid print samples of each color were fixed by a steaming treatment at 102° C. for 8 minutes. Thereafter, these print samples were washed with water to evaluate the resulting prints as to coloring ability, resistance to bleeding and susceptibility to staining on white portions. The results are shown in Table 1.

As apparent from Table 1, even the solid print samples of 100% duty were able to achieve high color depth, and all the print samples were good from the viewpoint of resistance to bleeding and susceptibility to staining on white portions.

EXAMPLE 3

The same woven fabric as that used in Example 1 was dipped into a tank containing an aqueous solution of 40% of a copolymer of vinylpyrrolidone and trimethylaminoethyl methacrylate chloride (ratio of the comonomers=1:1, weight average molecular weight: 5,000), 5% of sodium carbonate and 15% of ammonium sulfate, squeezed to a pickup of 100% and then dried to adjust the moisture regain of the fabric to 20%.

Using this woven fabric, printing was conducted in the same manner as in Example 1. The solid print samples of each color were fixed by a steaming treatment at 102° C. for 8 minutes. Thereafter, these print samples were washed with water to evaluate the resulting prints as to coloring ability, resistance to bleeding and susceptibility to staining on white portions. The results are shown in Table 1.

As apparent from Table 1, even the solid print samples of 100% duty were able to achieve high color depth, and all the print samples were good from the viewpoint of resistance to bleeding and susceptibility to staining on white portions.

COMPARATIVE EXAMPLE 1

The same woven fabric as that used in Example 1 was dipped into a tank containing an aqueous solution of 0.05 of a copolymer of vinylpyrrolidone and trimethylaminoethyl methacrylate chloride (ratio of the comonomers=1:1, weight average molecular weight: 10,000), 1% of sodium carbonate and 3% of ammonium sulfate, squeezed to a pickup of 100% and then dried to adjust the moisture regain of the fabric to 20%.

Using this woven fabric, printing was conducted in the same manner as in Example 1. The solid print samples of each color were fixed by a steaming treatment at 102° C. for 8 minutes. Thereafter, these print samples were washed with water to evaluate the resulting prints as to coloring ability, resistance to bleeding and susceptibility to staining on white portions. The results are shown in Table 1.

As apparent from Table 1, the coloring ability and resistance to bleeding were lowered compared with Example 1.

COMPARATIVE EXAMPLE 2

The same woven fabric as that used in Example 1 was dipped into a tank containing an aqueous solution of 55% of a copolymer of vinylpyrrolidone and trimethylaminoethyl methacrylate chloride (ratio of the comonomers=1:1, weight average molecular weight: 10,000), 1% of sodium carbonate and 3% of ammonium sulfate, squeezed to a pickup of 100% and then dried to adjust the moisture regain of the fabric to 20%.

Using this woven fabric, printing was conducted in the same manner as in Example 1. The solid print samples of each color were fixed by a steaming treatment at 102° C. for 8 minutes. Thereafter, these print samples were washed with water to evaluate the resulting prints as to coloring ability, resistance to bleeding and susceptibility to staining on white portions. The results are shown in Table 1.

As apparent from Table 1, the susceptibility to staining on white portions became worse compared with Example 1.

COMPARATIVE EXAMPLE 3

The same woven fabric as that used in Example 1 was dipped into a tank containing an aqueous solution of 3% of a copolymer of vinylpyrrolidone and trimethylaminoethyl methacrylate chloride (ratio of the comonomers=1:1, weight average molecular weight: 10,000) and 3% of ammonium sulfate, squeezed to a pickup of 100% and then dried to adjust the moisture regain of the fabric to 20%.

Using this woven fabric, printing was conducted in the same manner as in Example 1. The solid print samples of each color were fixed by a steaming treatment at 102° C. for 8 minutes. Thereafter, these print samples were washed with water to evaluate the resulting prints as to coloring ability, resistance to bleeding and susceptibility to staining on white portions. The results are shown in Table 1.

As apparent from Table 1, the coloring ability and resistance to bleeding were lowered compared with Example 1.

COMPARATIVE EXAMPLE 4

The same woven fabric as that used in Example 1 was dipped into a tank containing an aqueous solution of 3% of a copolymer of vinylpyrrolidone and trimethylaminoethyl methacrylate chloride (ratio of the comonomers=1:1, weight average molecular weight: 10,000), 6% of sodium carbonate and 3% of ammonium sulfate, squeezed to a pickup of 100% and then dried to adjust the moisture regain of the fabric to 20%.

Using this woven fabric, printing was conducted in the same manner as in Example 1. The solid print samples of each color were fixed by a steaming treatment at 102° C. for 8 minutes. Thereafter, these print samples were washed with water to evaluate the resulting prints as to coloring ability, resistance to bleeding and susceptibility to staining on white portions. The results are shown in Table 1.

As apparent from Table 1, the coloring ability and susceptibility to staining on white portions became worse compared with Example 1.

COMPARATIVE EXAMPLE 5

The same woven fabric as that used in Example 1 was dipped into a tank containing an aqueous solution of 3% of a copolymer of vinylpyrrolidone and trimethylaminoethyl methacrylate chloride (ratio of the comonomers=1:1, weight average molecular weight: 10,000) and 1% of sodium carbonate, squeezed to a pickup of 100% and then dried to adjust the moisture regain of the fabric to 20%.

Using this woven fabric, printing was conducted in the same manner as in Example 1. The solid print samples of each color were fixed by a steaming treatment at 102° C. for 8 minutes. Thereafter, these print samples were washed with water to evaluate the resulting prints as to coloring ability, resistance to bleeding and susceptibility to staining on white portions. The results are shown in Table 1.

As apparent from Table 1, the susceptibility to staining on white portions became worse compared with Example 1.

COMPARATIVE EXAMPLE 6

The same woven fabric as that used in Example 1 was dipped into a tank containing an aqueous solution of 3% of a copolymer of vinylpyrrolidone and trimethylaminoethyl methacrylate chloride (ratio of the comonomers=1:1, weight average molecular weight: 10,000), 1% of sodium carbonate and 22% of ammonium sulfate, squeezed to a pickup of 100% and then dried to adjust the moisture regain of the fabric to 20%.

Using this woven fabric, printing was conducted in the same manner as in Example 1. The solid print samples of each color were fixed by a steaming treatment at 102° C. for 8 minutes. Thereafter, these print samples were washed with water to evaluate the resulting prints as to coloring ability, resistance to bleeding and susceptibility to staining on white portions. The results are shown in Table 1.

As apparent from Table 1, the coloring ability became worse compared with Example 1.

COMPARATIVE EXAMPLE 7

The same woven fabric as that used in Example 1 was dipped into a tank containing an aqueous solution of 3% of a copolymer of vinylpyrrolidone and trimethylaminoethyl methacrylate chloride (ratio of the comonomers=1:1, weight average molecular weight: 10,000), 1% of sodium carbonate and 3% of ammonium chloride, squeezed to a pickup of 100% and then dried to adjust the moisture regain of the fabric to 20%.

Using this woven fabric, printing was conducted in the same manner as in Example 1. The solid print samples of each color were fixed by a steaming treatment at 102° C. for 8 minutes. Thereafter, these print samples were washed with water to evaluate the resulting prints as to coloring ability, resistance to bleeding and susceptibility to staining on white portions. The results are shown in Table 1.

As apparent from Table 1, the susceptibility to staining on white portions became worse compared with Example 1.

EXAMPLE 4

A blended plain weave fabric, formed of 85% Egyptian cotton having an average fiber length of 45 mm, an average fiber thickness of 1.2 denier and an average number of natural twist of 101/cm and 15% polyester fiber, was dipped into a tank containing an aqueous solution of 5% of a copolymer of acrylamide and diallyldimethylammonium chloride (ratio of the comonomer=1:1, weight average molecular weight: 1,000,000), 3% of sodium hydrogencarbonate and 2% of ammonium sulfate, squeezed to a pickup of 100% and then dried to adjust the moisture regain of the fabric to 15%.

Using this plain weave fabric, printing was conducted in the same manner as in Example 1. The solid print samples of each color were fixed by a steaming treatment at 102° C. for 8 minutes. Thereafter, these print samples were washed with water to evaluate the resulting prints as to coloring ability, resistance to bleeding and susceptibility to staining on white portions. The results are shown in Table 1.

As apparent from Table 1, even the solid print samples of 100% duty were able to achieve high color depth, and all the print samples were good from the viewpoint of resistance to bleeding and susceptibility to staining on white portions.

EXAMPLE 5

A 100% cotton plain weave fabric, formed of Egyptian cotton having an average fiber length of 45 mm, an average fiber thickness of 1.2 denier and an average number of natural twist of 101/cm, was dipped into a tank containing an aqueous solution of 2% of polyallylamine hydrochloride (weight average molecular weight: 10,000), 1% of sodium carbonate and 3% of ammonium citrate, squeezed to a pickup of 100% and then dried to adjust the moisture regain of the fabric to 17%.

Using this plain weave fabric, printing was conducted in the same manner as in Example 1. The solid print samples of each color were fixed by a steaming treatment at 102° C. for 8 minutes. Thereafter, these print samples were washed with water to evaluate the resulting prints as to coloring ability, resistance to bleeding and susceptibility to staining on white portions. The results are shown in Table 1.

As apparent from Table 1, even the solid print samples of 100% duty were able to achieve high color depth, and all the print samples were good from the viewpoint of resistance to bleeding and susceptibility to staining on white portions.

TABLE 1

| | Coloring ability[1)] | Resistance[2)] to bleeding | Staining on[3)] white portions |
|---|---|---|---|
| Ex. 1 | A | A | A |
| Ex. 2 | A | A | A |
| Ex. 3 | A | A | A |
| Ex. 4 | A | A | A |
| Ex. 5 | A | A | A |
| Comp. Ex. 1 | C | C | A |
| Comp. Ex. 2 | B | A | C |
| Comp. Ex. 3 | C | C | A |
| Comp. Ex. 4 | C | B | C |
| Comp. Ex. 5 | A | A | B |
| Comp. Ex. 6 | B | B | B |
| Comp. Ex. 7 | A | A | B |

[1)]K/S values of the solid print samples of 100% and 200% duties were determined to compare their values, thereby ranking the coloring ability in terms of their ratio (the value of the 200% duty sample/the value of the 100% duty sample) in accordance with the following standard. Incidentally, each K/S value was determined in accordance with the following equation:
K/S value = $(1 - R)^2/2R$ (R: reflectance at a maximum absorption wavelength).
A: Not higher than 1.5;
B: Higher than 1.5 but not higher than 1.8;
C: Higher than 1.8.

[2)]Irregularity of straight areas at edges was observed visually to rank the resistance to bleeding in accordance with the following standard:
A: No irregularity was observed;
B: Slight irregularity was observed; and
C: Marked irregularity was observed.

[3)]An unprinted sample fabric subjected to the steaming treatment was solid-printed, and the thus-printed fabric was washed with water together with its corresponding sample fabric subjected to the steaming treatment at a bath ratio of 1 kg/30 l for 15 minutes. Thereafter, a K/S value of the unprinted fabric was determined to rank the susceptibility to staining on white portions in terms of the remainder obtained by taking a K/S value before the water washing from this K/S value in accordance with the following standard:
A: Not higher than 0.1;
B: Higher than 0.1 but not higher than 0.2;
C: Higher than 0.2.

According to the ink-jet printing cloths of the present invention, as described above, there can be provided bright prints free of bleeding and high in color depth.

According to the printing process of the present invention, there can also be provided good prints which scarcely undergo staining on their white portions.

What is claimed is:

1. An ink-jet printing cloth which can be dyed with inks containing a reactive dye and is composed mainly of cellulose fiber, wherein the cloth contains, based on the dry weight of the cloth, 0.1 to 50% by weight of a cationic substance, 0.01 to 5% by weight of an alkaline substance and 0.01 to 20% by weight of the ammonium salt of a polyvalent acid.

2. The ink-jet printing cloth according to claim 1, wherein the cationic substance is a compound having m units of structural unit represented by the following formula (1) and n units of structural unit represented by the following formula (2):

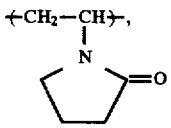

(1)

and

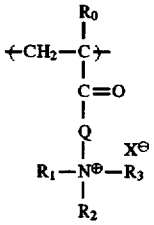

(2)

wherein X is Cl or F, $R_0$ is H or $CH_3$, $R_1$, $R_2$, and $R_3$ are, independently of one another, $CH_3$ or $C_2H_5$, and Q is $C_2H_4$ or O—$C_2H_4$, in which a ratio of m to n is within a range of from 8:2 to 2:8.

3. The ink-jet printing cloth according to claim 2, wherein the ratio of m to n is within a range of from 6:4 to 2:8.

4. The ink-jet printing cloth according to claim 2, wherein the cationic substance has a weight average molecular weight ranging from 3,000 to 100,000.

5. The ink-jet printing cloth according to claim 1, wherein the cationic substance is a compound having p units of structural unit represented by the following formula (3) and q units of structural unit represented by the following formula (4):

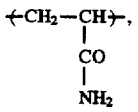

(3)

and

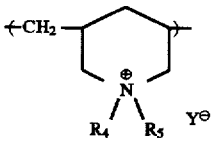

(4)

wherein Y is Cl or F, and $R_4$ and $R_5$ are, independently of each other, $CH_3$ or $C_2H_5$, in which a ratio of p to q is within a range of from 8:2 to 2:8.

6. The ink-jet printing cloth according to claim 5, wherein the ratio of p to q is within a range of from 6:4 to 2:8.

7. The ink-jet printing cloth according to claim 5, wherein the cationic substance has a weight average molecular weight ranging from 3,000 to 1,000,000.

8. The ink-jet printing cloth according to claim 1, wherein the cationic substance is a polymer having structural units represented by the formula

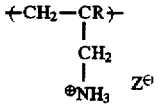

(5)

wherein Z is Cl or F, and R is H or $CH_3$.

9. The ink-jet printing cloth according to claim 8, wherein the cationic substance has a weight average molecular weight ranging from 3,000 to 100,000.

10. The ink-jet printing cloth according to claim 1, wherein the cellulose fiber has an average length ranging from 25 to 60 mm, an average thickness ranging from 0.6 to 2.2 deniers and an average number of natural twist ranging from 70/cm to 150/cm.

11. The ink-jet printing cloth according to claim 1, wherein the cloth has a moisture regain ranging from 13.5 to 108.5%.

12. The ink-jet printing cloth according to claim 1, wherein the alkaline substance is selected from the group consisting of sodium hydroxide, potassium hydroxide, mono-, di- and triethanolamines, sodium carbonate, potassium carbonate and sodium bicarbonate.

13. The ink-jet printing cloth according to claim 12, wherein the alkaline substance is sodium carbonate or sodium bicarbonate.

14. The ink-jet printing cloth according to claim 1, wherein the ammonium salt is the ammonium salt of a polyvalent acid selected from the group consisting of polyvalent inorganic acids, polyvalent organic carboxylic acids, polyvalent alkylbenzenesulfonic acids and polyvalent polymer acids.

15. The ink-jet printing cloth according to claim 14, wherein the ammonium salt is ammonium sulfate or ammonium citrate.

16. The ink-jet printing cloth according to claim 1, wherein the amount of the cationic substance is within a range of from 0.5 to 40% by weight based on the dry weight of the cloth.

17. The ink-jet printing cloth according to claim 1, wherein the amount of the ammonium salt of a polyvalent acid is within a range of from 0.03 to 15% by weight based on the dry weight of the cloth.

18. The ink-jet printing cloth according to claim 1, wherein the combined proportion of the alkaline substance to the ammonium salt of the polyvalent acid falls within a range of from 1:1 to 1:10 in terms of weight ratio.

19. The ink-jet printing cloth according to claim 18, wherein the combined proportion of the alkaline substance to the ammonium salt of the polyvalent acid falls within a range of from 1:2 to 1:5 in terms of weight ratio.

20. A textile printing process comprising applying textile printing inks to a cloth by an ink-jet system, wherein said cloth is the ink-jet printing cloth according to any one of claims 1 to 19, 16 and 17, and a dyeing treatment is carried out after the application of the inks to the cloth, followed by a washing treatment.

21. The textile printing process according to claim 20, wherein the ink-jet system is an ink-jet system using thermal energy.

22. A print produced in accordance with the textile printing process according to claim 20.

* * * * *

UNITED STATES PATENT AND TRADEMARK OFFICE

CERTIFICATE OF CORRECTION

PATENT NO. : 5,698,478

DATED : December 16, 1997

INVENTOR(S) : TOMOYA YAMAMOTO, ET AL.

It is certified that error appears in the above-identified patent and that said Letters Patent is hereby corrected as shown below:

COLUMN 7:

Line 47, "Variety" should read --variety--.

COLUMN 9:

Line 10, "according" should read --according to--.
Line 11, "to" (second occurrence) should be deleted.

COLUMN 16:

Line 58, "16 and 17," should be deleted.

Signed and Sealed this

Twenty-first Day of July, 1998

Bruce Lehman

*Attest:*

BRUCE LEHMAN

*Attesting Officer*

*Commissioner of Patents and Trademarks*